US010134574B2

(12) United States Patent
Kenny et al.

(10) Patent No.: US 10,134,574 B2
(45) Date of Patent: Nov. 20, 2018

(54) PRE-FILTER FRAGMENTATION

(71) Applicant: Micromass UK Limited, Wilmslow (GB)

(72) Inventors: Daniel James Kenny, Knutsford (GB); Martin Raymond Green, Bowdon (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/076,053

(22) Filed: Mar. 21, 2016

(65) Prior Publication Data

US 2016/0284526 A1 Sep. 29, 2016

(30) Foreign Application Priority Data

Mar. 23, 2015 (GB) ..... 1504817.6

(51) Int. Cl.
*H01J 49/00* (2006.01)
*H01J 49/06* (2006.01)

(52) U.S. Cl.
CPC ..... *H01J 49/005* (2013.01); *H01J 49/0045* (2013.01); *H01J 49/06* (2013.01)

(58) Field of Classification Search
CPC ..... H01J 49/0045; H01J 49/005; H01J 49/24; H01J 49/006
See application file for complete search history.

(56) References Cited

U.S. PATENT DOCUMENTS

| | | | |
|---|---|---|---|
| 5,847,386 | A | 12/1998 | Thomson et al. |
| 6,015,972 | A | 1/2000 | Hager |
| 6,720,554 | B2 | 4/2004 | Hager |
| 7,034,292 | B1 | 4/2006 | Whitehouse et al. |
| 7,312,442 | B2 | 12/2007 | Hansen |
| 7,534,622 | B2 | 5/2009 | Hunt et al. |
| 8,198,580 | B2 | 6/2012 | Schwartz et al. |
| 8,445,843 | B2 | 5/2013 | Kenny |

(Continued)

FOREIGN PATENT DOCUMENTS

GB 2391698 7/2004

OTHER PUBLICATIONS

McFarland et al., "*Ion 'Threshing': Collisionally Activated Dissociation in an External Octopole Ion Trap by Oscillation of an Axial Electric Potential Gradient*", Anal. Chem., vol. 76, No. 6, pp. 1545-1549, 2004.

*Primary Examiner* — Eliza Osenbaugh-Stewart

(57) ABSTRACT

A method of fragmenting ions is disclosed comprising providing a linear ion trap comprising: (i) a first electrode set comprising a plurality of first electrodes; (ii) a second electrode set arranged downstream of the first electrode set and comprising a plurality of second electrodes; and (iii) a third electrode set arranged downstream of the second electrode set and comprising a plurality of third electrodes. Ions are axially confined within the linear ion trap. Either: (i) a potential difference between at least some of the first electrodes and at least some of the second electrodes; and/or (ii) a potential difference between at least some of the second electrodes and at least some of the third electrodes, is varied in order to accelerate at least some ions confined within the linear ion trap in order to cause the ions to fragment so as to form fragment or daughter ions.

22 Claims, 2 Drawing Sheets

(56) References Cited

U.S. PATENT DOCUMENTS

| | | | | |
|---|---|---|---|---|
| 8,487,248 | B2 | 7/2013 | Green | |
| 8,610,056 | B2 | 12/2013 | Whitehouse et al. | |
| 9,012,840 | B2 | 4/2015 | Bateman et al. | |
| 2003/0168589 | A1 | 9/2003 | Hager | |
| 2007/0158550 | A1* | 7/2007 | Wells | H01J 49/4225 250/292 |
| 2009/0173877 | A1* | 7/2009 | Bateman | G01N 27/622 250/282 |
| 2009/0179148 | A1* | 7/2009 | Yasuda | H01J 49/004 250/282 |
| 2012/0032074 | A1* | 2/2012 | Kenny | H01J 49/0031 250/283 |

* cited by examiner

PRE-FILTER FRAGMENTATION

CROSS-REFERENCE TO RELATED APPLICATION

This application claims priority from and the benefit of United Kingdom patent application No. 1504817.6 filed on 23 Mar. 2015. The entire contents of this application is incorporated herein by reference.

FIELD OF THE INVENTION

The present invention relates generally to mass and/or ion mobility spectrometry and in particular to methods of fragmenting ions, methods of mass and/or ion mobility spectrometry, apparatus for fragmenting ions and mass and/or ion mobility spectrometers.

BACKGROUND

It is often necessary to determine the identity or internal structure of a compound and a common method used for this purpose is ion fragmentation. Tandem mass spectrometry (MS/MS or $MS^2$) analysis, for example, is a common technique whereby target compound ions having a specific mass to charge ratio are first isolated and then fragmented. The resultant fragment ions are then mass analysed.

Quadrupole tandem mass spectrometers, which typically comprise two quadrupole mass filters ("QMF") separated by a fragmentation cell, are prevalent and are commonly used for tandem mass spectrometry. The quadrupole mass filters are typically located within respective vacuum chambers and are operated at relatively low pressures as compared with the fragmentation cell.

Quadrupole mass filters are well known and typically comprise an analytical quadrupole in combination with a pre-filter quadrupole and a post-filter quadrupole. In operation, an RF voltage and a resolving DC voltage are simultaneously applied to the rod electrodes of the analytical quadrupole so that the mass filter operates in a mass or mass to charge ratio resolving mode of operation.

In certain situations tandem mass spectrometry ($MS^2$) is either not sufficiently specific or else further structural information is required. If further structural information is required then an MS/MS/MS (or $MS^3$) analysis may be performed whereby target compound ions are isolated and fragmented. Specific first generation fragment ions are then isolated and are further fragmented to form a plurality of second generation fragment ions. Successive repeats of isolation and fragmentation steps may be strung together and the general technique is commonly known as $MS^n$.

Dedicated instruments capable of performing $MS^3$ or $MS^n$ analysis are known. For example, U.S. Pat. No. 7,034,292 (Whitehouse) discloses arrangements comprising multiple multipole ion guides arranged in series, wherein collisional induced dissociation ("CID") of ions is conducted by axially accelerating ions from one multipole ion guide into an adjacent multipole ion guide.

However, it is often desirable to be able to perform $MS^3$ or $MS^n$ analysis in a less complex and more commonly available instrument such as quadrupole tandem mass spectrometer.

In order to perform $MS^3$ and/or $MS^n$ analysis using a quadrupole tandem mass spectrometer it is necessary to use an existing part of the instrument to perform the one or more additional stages of mass isolation and fragmentation.

One known solution involves causing ions to fragment as they are transferred from one quadrupole mass filter into another quadrupole mass filter. For example, US 2003/0168589 (Hager) discloses an arrangement in which ions may be fragmented by accelerating them from one quadrupole rod set into another quadrupole rod set.

Another known solution is to use a quadrupole mass filter of a tandem mass spectrometer as a linear ion trap ("LIT") and to perform multiple stages of isolation and/or fragmentation within the linear ion trap. Performing multiple stages of isolation and/or fragmentation within a single quadrupole mass filter provides more flexibility and control when compared with techniques in which ions are fragmented as they are transferred from one quadrupole mass filter into another quadrupole mass filter.

These techniques may also be used to perform fragmentation or $MS^2$ analysis using a single quadrupole mass filter/linear ion trap.

Parent or precursor ions can be isolated within the linear ion trap using a variety of known methods.

There are various different known methods of fragmenting ions within a linear ion trap including: (i) resonant excitation wherein a "tickle" voltage is applied between diametrically opposite rods in order to radially excite an ion within the linear ion trap until the ion undergoes Collision Induced Dissociation ("CID") via collision with a residual gas molecule; (ii) boundary activated dissociation comprising applying resolving RF/DC voltages to a linear ion trap to give the ions higher amplitude motion so as to cause Collision Induced Dissociation ("CID") (see, for example, U.S. Pat. No. 6,015,972 (Hager)); and (iii) ion threshing wherein an axial DC field is applied along the length of a linear ion trap which is rapidly switched to drive the ions axially back and forth to cause Collision Induced Dissociation ("CID") (see, for example, U.S. Pat. No. 5,847,386 (Thomson)).

The known boundary activated dissociation approach is relatively complex and requires tight control of the RF and resolving DC voltages applied to the quadrupole which can disadvantageously conflict with the other operational requirements of the quadrupole.

The known resonant excitation approach and the known ion threshing approach require various physical modifications to existing quadrupole mass filter or linear ion trap hardware which is disadvantageous.

US 2011/0309244 (Whitehouse) discloses a method in which collisional induced dissociation ("CID") of ions is performed within a linear multipole ion guide by either: (i) exciting ions with a resonant frequency; (ii) releasing ions from the ion guide and then accelerating the ions back into the ion guide; or (iii) filling the ion guide with a critical level of ions. These approaches are again relatively complex and/or require various physical modifications to existing quadrupole mass filter or linear ion trap hardware which is disadvantageous.

It is therefore desired to provide an improved mass spectrometer.

SUMMARY

According to an aspect there is provided a method of fragmenting ions comprising:

providing a linear ion trap comprising: (i) a first electrode set comprising a plurality of first electrodes; (ii) a second electrode set arranged downstream of the first electrode set and comprising a plurality of second electrodes; and (iii) a third electrode set arranged downstream of the second electrode set and comprising a plurality of third electrodes;

axially confining ions within the linear ion trap; and varying either: (i) a potential difference between at least some of the first electrodes and at least some of the second electrodes; and/or (ii) a potential difference between at least some of the second electrodes and at least some of the third electrodes, in order to accelerate at least some ions confined within the linear ion trap in order to cause the ions to fragment so as to form fragment or daughter ions.

Various embodiments relate to a new method of ion fragmentation within a linear ion trap which is relatively simple and which does not require any physical changes or additions to an existing quadrupole mass filter/linear ion trap and/or tandem mass spectrometry hardware.

The approach according to various embodiments is in contrast to conventional resonant excitation, boundary activated dissociations and ion threshing approaches.

The approach according to various embodiments is also in contrast with the approach disclosed in U.S. Pat. No. 7,034,292 (Whitehouse), US 2003/0168589 (Hager) and US 2011/0309244 (Whitehouse). U.S. Pat. No. 7,034,292 (Whitehouse) and US 2003/0168589 (Hager) disclose arrangements in which ions are fragmented by accelerating them from one quadrupole mass filter into another quadrupole mass filter, and do not disclose an arrangement in which ions are confined axially and fragmented within a linear ion trap. Equally, US 2011/0309244 (Whitehouse) does not disclose varying a potential difference between first and second electrodes and/or between second and third electrodes of a linear ion trap in order to accelerate ions confined within the linear ion trap so as to cause the ions to fragment.

Various embodiments can beneficially be used to perform ion fragmentation and/or $MS^2$, $MS^3$ and/or $MS^n$ analysis using existing (standard) quadrupole mass filter/linear ion trap and/or tandem mass spectrometry hardware.

A pulsed DC voltage may be applied to the pre-filter and/or post filter of a quadrupole mass filter so that ions are accelerated into and/or out of the pre-filer and/or post-filter and the ions may be arranged to collide energetically with residual gas molecules within the vacuum system of the quadrupole mass filter.

Various embodiments allow ion fragmentation to be affected within a quadrupole mass filter or a linear ion trap ("QMF/LIT") with minimal hardware changes to a conventional arrangement.

It will be appreciated, therefore, that various embodiments provide an improved method of fragmenting ions.

The plurality of first electrodes may comprise a plurality of rod electrodes and/or the plurality of second electrodes may comprise a plurality of rod electrodes and/or the plurality of third electrodes may comprise a plurality of rod electrodes.

The first electrode set may have an axial length less than an axial length of the second electrode set; and/or the third electrode set may have an axial length less than the axial length of the second electrode set.

The axial length of the first electrode set may be less than about 50%, 40%, 30%, 20% or 10% of the axial length of the second electrode set; and/or the axial length of the third electrode set may be less than about 50%, 40%, 30%, 20% or 10% of the axial length of the second electrode set.

The first electrode set may comprise a pre-filter quadrupole and/or the second electrode set may comprise an analytical quadrupole and/or the third electrode set may comprise a post-filter quadrupole.

The first electrode set, the second electrode set and the third electrode set may form a segmented rod set.

The second electrode set may comprise an analytical quadrupole and/or the plurality of first electrodes may comprise a plurality of first vane electrodes and/or the plurality of third electrodes may comprise a plurality of second vane electrodes.

Ions may be accelerated and may be caused to fragment by Collision Induced Dissociation ("CID") so as to form the fragment or daughter ions.

The ions may be caused to fragment by Collision Induced Dissociation ("CID") with gas molecules within the linear ion trap.

The method may comprise accelerating at least some of the ions within the linear ion trap from the second electrode set towards and/or into the first electrode set and/or the third electrode set.

The method may comprise accelerating at least some of the ions within the linear ion trap from the first electrode set and/or the third electrode set towards and/or into the second electrode set.

Varying the potential difference between at least some of the first electrodes and at least some of the second electrodes may comprise applying one or more DC voltages to at least some of the first electrodes and/or to at least some of the second electrodes; and/or varying the potential difference between at least some of the second electrodes and at least some of the third electrodes may comprise applying one or more DC voltages to at least some of the second electrodes and/or to at least some of the third electrodes.

Varying the potential difference between at least some of the first electrodes and at least some of the second electrodes may comprise raising or lowering one or more DC voltages applied to at least some of the first electrodes and/or to at least some of the second electrodes; and/or varying the potential difference between at least some of the second electrodes and at least some of the third electrodes may comprise raising or lowering one or more DC voltages applied to at least some of the second electrodes and/or at least some of the third electrodes.

The method may comprise accelerating at least some of the ions within the linear ion trap during a first time period $T_1$.

The method may comprise varying either: (i) the potential difference between at least some of the first electrodes and at least some of the second electrodes a plurality of times; and/or (ii) the potential difference between at least some of the second electrodes and at least some of the third electrodes a plurality of times, in order to accelerate at least some ions confined within the linear ion trap a plurality of times.

The linear ion trap may comprise one or more entrance electrodes arranged upstream of the first electrode set and/or one or more exit electrodes arranged downstream of the third electrode set.

Axially confining ions within the linear ion trap may comprise applying one or more DC voltages to the one or more entrance electrodes and/or to the one or more exit electrodes.

The method may comprise applying one or more RF voltages to the first electrodes and/or to the second electrodes and/or to the third electrodes so as to confine ions radially within the linear ion trap.

The method may comprise applying a resolving DC voltage to the first electrodes and/or to the second electrodes and/or to the third electrodes so as to filter at least some of the ions within the linear ion trap according to their mass or mass to charge ratio.

The method may comprise applying the resolving DC voltage to the first electrodes and/or to the second electrodes and/or to the third electrodes during a second time period $T_2$.

The second time period $T_2$ may have a duration selected from the group consisting of: (i)<100 μs; (ii) 100-200 μs; (iii) 200-400 μs; (iv) 400-600 μs; (v) 600-800 μs; (vi) 800-1000 μs; and (vii) >1000 μs.

The method may comprise applying the resolving DC voltage to the first electrodes and/or to the second electrodes and/or to the third electrodes before the step of varying either: (i) the potential difference between at least some of the first electrodes and at least some of the second electrodes; and/or (ii) the potential difference between at least some of the second electrodes and at least some of the third electrodes.

The method may comprise:

generating one or more additional axial electric fields within the linear ion trap so as to urge at least some of the ions within the linear ion trap from the first electrode set and/or the third electrode set towards and/or into the second electrode set; and/or generating one or more additional axial electric fields within the linear ion trap so as to urge at least some of the ions within the linear ion trap from the second electrode set towards and/or into the first electrode set and/or the third electrode set.

The first electrode set, the second electrode set and the third electrode set may be arranged in a first vacuum chamber, and the method may further comprise vacuum pumping the first vacuum chamber.

The pressure within or at the second electrode set may be less than the pressure within or at the first and/or third electrode set.

The method may comprise providing gas to the linear ion trap.

The method may comprise providing gas to the first vacuum chamber.

The method may comprise providing gas to the linear ion trap and/or to the first vacuum chamber such that the pressure within or at the second electrode set is less than the pressure within or at the first and/or third electrode set.

The method may comprise providing a first device or stage upstream of the first electrode set, the second electrode set and the third electrode set.

The first device or stage may be coupled to the linear ion trap and/or to the first vacuum chamber via a differential pumping aperture and/or an atmospheric pressure interface.

The method may comprise providing gas to the linear ion trap and/or to the first vacuum stage from the first device or stage.

The method may comprise providing the gas to the linear ion trap and/or to the first vacuum stage from the first device or stage such that a pressure differential is formed within the linear ion trap and/or the first vacuum chamber.

The pressure within or at the linear ion trap and/or the first vacuum chamber may be less than the pressure within or at the first device or stage.

The first device or stage may comprise an ion source.

The ion source may comprise an atmospheric pressure ion source.

The method may comprise providing a second device or stage downstream of the first electrode set, the second electrode set and the third electrode set.

The second device or stage may be coupled to the linear ion trap and/or to the first vacuum chamber via a differential pumping aperture.

The method may comprise providing gas to the linear ion trap and/or to the first vacuum chamber from the second device or stage.

The method may comprise providing the gas to the linear ion trap and/or to the first vacuum chamber from the second device or stage such that a pressure differential is formed within the linear ion trap and/or the first vacuum chamber.

The pressure within or at the linear ion trap and/or the first vacuum chamber may be less than the pressure within or at the second device or stage.

The second device or stage may comprise a second vacuum chamber.

The second device or stage may comprise a collision, reaction or fragmentation device.

The method may comprise providing the gas to the linear ion trap from one or more devices arranged upstream of the first electrode set, the second electrode set and the third electrode set and/or from one or more devices arranged downstream of the first electrode set, the second electrode set and the third electrode set such that a pressure differential may be formed within the linear ion trap.

The method may comprise providing gas to the linear ion trap from one or more devices arranged upstream of the first electrode set, the second electrode set and the third electrode set and/or from one or more devices arranged downstream of the first electrode set, the second electrode set and the third electrode set such that a pressure differential is formed within the linear ion trap.

The method may comprise varying the pressure of gas provided to the linear ion trap and/or to the first vacuum chamber.

The method may comprise varying with time the pressure of the gas provided to the linear ion trap.

The method may comprise providing gas to the linear ion trap from a pulsed gas source.

The method may comprise varying the pressure of the gas at the same time as and/or in synchronism with the step of varying either: (i) the potential difference between at least some of the first electrodes and at least some of the second electrodes; and/or (ii) the potential difference between at least some of the second electrodes and at least some of the third electrodes.

The step of varying the pressure of the gas may comprise increasing the pressure of the gas.

The step of varying the pressure of the gas may comprise pulsing the pressure of the gas.

The step of varying the pressure of the gas may comprise varying the pressure of the gas such that the pressure is temporarily increased during the time period $T_1$.

The method may comprise passing at least some of the fragment or daughter ions from the linear ion trap to one or more devices arranged upstream and/or downstream of the linear ion trap.

The method may comprise causing at least some of the fragment or daughter ions to fragment so as to form second or further generation fragment ions.

The step of passing at least some of the fragment or daughter ions from the linear ion trap to the one or more devices arranged upstream and/or downstream of the linear ion trap may cause at least some of the ions to fragment so as to form the second or further generation fragment ions.

The method may comprise mass and/or ion mobility analysing at least some of the fragment or daughter ions or ions derived from the fragment or daughter ions.

The method may comprise:

mass filtering at least some of the fragment or daughter ions or ions derived from the fragment or daughter ions according to their mass or mass to charge ratio; and/or separating at least some of the fragment or daughter ions or ions derived from the fragment or daughter ions according to their ion mobility, collision cross section, interaction cross section and/or differential ion mobility.

According to another aspect there is provided a method of mass spectrometry and/or ion mobility spectrometry comprising a method of fragmenting ions as described above.

According to another aspect there is provided a method of mass spectrometry comprising a method of fragmenting ions as described above.

The method of mass spectrometry may comprise mass analysing at least some of the fragment or daughter ions.

The method of mass spectrometry may comprise mass filtering at least some of the fragment or daughter ions according to their mass or mass to charge ratio.

The method of mass spectrometry may comprise causing at least some of the fragment or daughter ions to fragment so as to form second or further generation fragment ions.

The method of mass spectrometry may comprise mass analysing at least some of the second fragment or further generation ions.

According to another aspect there is provided apparatus for fragmenting ions comprising:

a linear ion trap comprising: (i) a first electrode set comprising a plurality of first electrodes; (ii) a second electrode set arranged downstream of the first electrode set and comprising a plurality of second electrodes; and (iii) a third electrode set arranged downstream of the second electrode set and comprising a plurality of third electrodes; and a control system arranged and adapted:

(i) to cause ions to be axially confined within the linear ion trap; and (ii) to vary either: (a) a potential difference between at least some of the first electrodes and at least some of the second electrodes; and/or (b) a potential difference between at least some of the second electrodes and at least some of the third electrodes, in order to accelerate at least some ions confined within the linear ion trap in order to cause the ions to fragment so as to form fragment or daughter ions.

The plurality of first electrodes may comprise a plurality of rod electrodes.

The plurality of second electrodes may comprise a plurality of rod electrodes.

The plurality of third electrodes may comprise a plurality of rod electrodes.

The first electrode set may have an axial length less than an axial length of the second electrode set; and/or the third electrode set may have an axial length less than the axial length of the second electrode set.

The axial length of the first electrode set may be less than about 50%, 40%, 30%, 20% or 10% of the axial length of the second electrode set; and/or the axial length of the third electrode set may be less than about 50%, 40%, 30%, 20% or 10% of the axial length of the second electrode set.

The first electrode set may comprise a pre-filter quadrupole.

The second electrode set may comprise an analytical quadrupole.

The third electrode set may comprise a post-filter quadrupole.

The first electrode set, the second electrode set and the third electrode set may form a segmented rod set.

The plurality of first electrodes may comprise a plurality of first vane electrodes.

The plurality of third electrodes may comprise a plurality of second vane electrodes.

The control system and/or the apparatus may be arranged and adapted to vary the potential difference in order to accelerate the ions and to cause the ions to fragment by Collision Induced Dissociation ("CID") so as to form the fragment or daughter ions.

The control system and/or the apparatus may be arranged and adapted to vary the potential difference in order to accelerate at least some of the ions within the linear ion trap from the second electrode set towards the first electrode set and/or the third electrode set.

The control system and/or the apparatus may be arranged and adapted to vary the potential difference in order to accelerate at least some of the ions within the linear ion trap from the second electrode set into the first electrode set and/or the third electrode set.

The control system and/or the apparatus may be arranged and adapted to vary the potential difference in order to accelerate at least some of the ions within the linear ion trap from the first electrode set and/or the third electrode set towards the second electrode set.

The control system and/or the apparatus may be arranged and adapted to vary the potential difference in order to accelerate at least some of the ions within the linear ion trap from the first electrode set and/or the third electrode set into the second electrode set.

The control system and/or the apparatus may be arranged and adapted to vary the potential difference between at least some of the first electrodes and at least some of the second electrodes by applying one or more DC voltages to at least some of the first electrodes and/or to at least some of the second electrodes.

The control system and/or the apparatus may be arranged and adapted to vary the potential difference between at least some of the second electrodes and at least some of the third electrodes by applying one or more DC voltages to at least some of the second electrodes and/or to at least some of the third electrodes.

The control system and/or the apparatus may be arranged and adapted to vary the potential difference between at least some of the first electrodes and at least some of the second electrodes by raising or lowering one or more DC voltages applied to at least some of the first electrodes and/or to at least some of the second electrodes.

The control system and/or the apparatus may be arranged and adapted to vary the potential difference between at least some of the second electrodes and at least some of the third electrodes by raising or lowering one or more DC voltages applied to at least some of the second electrodes and/or at least some of the third electrodes.

The control system and/or the apparatus may be arranged and adapted to vary the potential difference between at least some of the first electrodes and at least some of the second electrodes a plurality of times in order to accelerate at least some ions confined within the linear ion trap.

The control system and/or the apparatus may be arranged and adapted to vary the potential difference between at least some of the second electrodes and at least some of the third electrodes a plurality of times in order to accelerate at least some ions confined within the linear ion trap a plurality of times.

The linear ion trap may comprise one or more entrance electrodes arranged upstream of the first electrode set and/or one or more exit electrodes arranged downstream of the third electrode set.

The control system and/or the apparatus may be arranged and adapted to axially confine ions within the linear ion trap by applying one or more DC voltages to the one or more entrance electrodes and/or to the one or more exit electrodes.

The control system and/or the apparatus may be arranged and adapted to apply one or more RF voltages to the first electrodes and/or to the second electrodes and/or to the third electrodes so as to confine ions radially within the linear ion trap.

The control system and/or the apparatus may be arranged and adapted to accelerate at least some of the ions within the linear ion trap during a first time period $T_1$.

The control system and/or the apparatus may be arranged and adapted to apply a resolving DC voltage to the first electrodes and/or to the second electrodes and/or to the third electrodes so as to filter at least some of the ions within the linear ion trap according to their mass or mass to charge ratio.

The control system and/or the apparatus may be arranged and adapted to apply the resolving DC voltage to the first electrodes and/or to the second electrodes and/or to the third electrodes during a second time period $T_2$.

The second time period $T_2$ may have a duration selected from the group consisting of: (i)<100 μs; (ii) 100-200 μs; (iii) 200-400 μs; (iv) 400-600 μs; (v) 600-800 μs; (vi) 800-1000 μs; and (vii) >1000 μs.

The control system and/or the apparatus may be arranged and adapted to apply the resolving DC voltage to the first electrodes and/or to the second electrodes and/or to the third electrodes before varying either: (i) the potential difference between at least some of the first electrodes and at least some of the second electrodes; and/or (ii) the potential difference between at least some of the second electrodes and at least some of the third electrodes.

The control system and/or the apparatus may be arranged and adapted:

to generate one or more additional axial electric fields within the linear ion trap so as to urge at least some of the ions within the linear ion trap from the first electrode set and/or the third electrode set towards the second electrode set; and/or to generate one or more additional axial electric fields within the linear ion trap so as to urge at least some of the ions within the linear ion trap from the second electrode set towards the first electrode set and/or the third electrode set.

The first electrode set, the second electrode set and the third electrode set may be arranged in a first vacuum chamber, and the apparatus may comprise a vacuum pump arranged and adapted to pump the first vacuum chamber.

The pressure within or at the second electrode set may be arranged to be less than the pressure within or at the first and/or third electrode set.

The apparatus may comprise one or more devices arranged and adapted to provide gas to the linear ion trap and/or to the first vacuum chamber.

The one or more devices may be arranged and adapted to provide gas to the linear ion trap and/or to the first vacuum chamber such that the pressure within or at the second electrode set is less than the pressure within or at the first and/or third electrode set.

The apparatus may comprise a first device or stage upstream of the first electrode set, the second electrode set and the third electrode set.

The first device or stage may be coupled to the linear ion trap and/or to the first vacuum chamber via a differential pumping aperture and/or an atmospheric pressure interface.

The first device or stage may be arranged and adapted to provide gas to the linear ion trap and/or to the first vacuum stage.

The first device or stage may be arranged and adapted to provide the gas to the linear ion trap and/or to the first vacuum stage such that a pressure differential is formed within the linear ion trap and/or the first vacuum chamber.

The pressure within or at the linear ion trap and/or the first vacuum chamber may be arranged to be less than the pressure within or at the first device or stage.

The first device or stage may comprise an ion source.

The ion source may comprise an atmospheric pressure ion source.

The apparatus may comprise a second device or stage downstream of the first electrode set, the second electrode set and the third electrode set.

The second device or stage may be coupled to the linear ion trap and/or to the first vacuum chamber via a differential pumping aperture.

The second device or stage may be arranged and adapted to provide gas to the linear ion trap and/or to the first vacuum chamber.

The second device or stage may be arranged and adapted to provide the gas to the linear ion trap and/or to the first vacuum chamber such that a pressure differential is formed within the linear ion trap and/or the first vacuum chamber.

The pressure within or at the linear ion trap and/or the first vacuum chamber may be arranged to be less than the pressure within or at the second device or stage.

The second device or stage may comprise a second vacuum chamber.

The second device or stage may comprise a collision, reaction or fragmentation device.

The control system and/or the apparatus may be arranged and adapted to vary the pressure of gas provided to the linear ion trap and/or to the first vacuum chamber.

The control system and/or the apparatus may be arranged and adapted to vary the pressure of the gas at the same time as varying either: (i) the potential difference between at least some of the first electrodes and at least some of the second electrodes; and/or (ii) the potential difference between at least some of the second electrodes and at least some of the third electrodes.

The control system and/or the apparatus may be arranged and adapted to vary the pressure of the gas in synchronism with varying either: (i) the potential difference between at least some of the first electrodes and at least some of the second electrodes; and/or (ii) the potential difference between at least some of the second electrodes and at least some of the third electrodes.

The control system and/or the apparatus may be arranged and adapted to vary the pressure of the gas by increasing the pressure of the gas.

The control system and/or the apparatus may be arranged and adapted to vary the pressure of the gas by pulsing the pressure of the gas.

The control system and/or the apparatus may be arranged and adapted to vary the pressure of the gas by varying the pressure of the gas such that the pressure is temporarily increased during the time period $T_1$.

The control system and/or the apparatus may be arranged and adapted to cause at least some of the fragment or daughter ions to be passed from the linear ion trap to one or more devices arranged upstream and/or downstream of the linear ion trap.

The apparatus may comprise a fragmentation, collision or reaction device arranged and adapted to fragment at least some of the fragment or daughter ions so as to form second or further generation fragment ions.

The apparatus may be arranged and adapted such that passing at least some of the fragment or daughter ions from the linear ion trap to the one or more devices arranged upstream and/or downstream of the linear ion trap causes at least some of the ions to fragment so as to form the second or further generation fragment ions.

The apparatus may comprise a mass and/or ion mobility analyser for mass and/or ion mobility analysing at least some of the fragment or daughter ions or ions derived from the fragment or daughter ions.

The apparatus may comprise:

a mass filter for mass filtering at least some of the fragment or daughter ions or ions derived from the fragment or daughter ions according to their mass or mass to charge ratio; and/or an ion mobility separator for separating at least some of the fragment or daughter ions or ions derived from the fragment or daughter ions according to their ion mobility, collision cross section, interaction cross section and/or differential ion mobility.

According to an aspect there is provided a mass spectrometer and/or ion mobility spectrometer comprising apparatus as described above.

According to another aspect there is provided a mass spectrometer comprising apparatus as described above.

According to another aspect there is provided a method of fragmenting ions comprising:

providing a linear ion trap comprising: (i) a pre-filter quadrupole; (ii) an analytical quadrupole arranged downstream of the pre-filter quadrupole; and (iii) a post-filter quadrupole arranged downstream of the analytical quadrupole;

axially confining ions within the linear ion trap; and varying either: (i) a potential difference between the pre-filter quadrupole and the analytical quadrupole; and/or (ii) a potential difference between the analytical quadrupole and the post-filter quadrupole, in order to accelerate at least some ions confined within the linear ion trap in order to cause the ions to fragment so as to form fragment or daughter ions.

According to another aspect there is provided apparatus for fragmenting ions comprising:

a linear ion trap comprising: (i) a pre-filter quadrupole; (ii) an analytical quadrupole arranged downstream of the pre-filter quadrupole; and (iii) a post-filter quadrupole arranged downstream of the analytical quadrupole; and a control system arranged and adapted:

(i) to cause ions to be axially confined within the linear ion trap; and (ii) to vary either: (a) a potential difference between the pre-filter quadrupole and the analytical quadrupole; and/or (b) a potential difference between the analytical quadrupole and the post-filter quadrupole, in order to accelerate at least some ions confined within the linear ion trap in order to cause the ions to fragment so as to form fragment or daughter ions.

According to another aspect there is provided a method of fragmenting ions comprising:

providing gas to an ion trap;

accelerating ions within the ion trap one or more times in order to cause the ions to fragment so as to form fragment or daughter ions; and varying with time the pressure of the gas provided to the ion trap in synchronism with the step of accelerating the ions within the ion trap one or more times.

The method may comprise accelerating the ions within the ion trap in order to cause the ions to fragment by Collision Induced Dissociation ("CID") so as to form the fragment or daughter ions.

The step of varying the pressure of the gas may comprise increasing the pressure of the gas.

The step of varying the pressure of the gas may comprise pulsing the pressure of the gas.

The step of varying the pressure of the gas may comprise varying the pressure of the gas such that the pressure is temporarily increased when the ions are accelerated within the ion trap.

According to another aspect there is provided apparatus for fragmenting ions comprising:

an ion trap;

a first device arranged and adapted to provide gas to the ion trap; and a control system arranged and adapted:

(i) to accelerate ions within the ion trap one or more times in order to cause the ions to fragment so as to form fragment or daughter ions; and (ii) to vary with time the pressure of the gas provided to the ion trap by the first device in synchronism with accelerating the ions within the ion trap one or more times.

The control system and/or the apparatus may be arranged and adapted to accelerate the ions within the ion trap in order to cause the ions to fragment by Collision Induced Dissociation ("CID") so as to form the fragment or daughter ions.

The control system and/or the apparatus may be arranged and adapted to vary the pressure of the gas by increasing the pressure of the gas.

The control system and/or the apparatus may be arranged and adapted to vary the pressure of the gas by pulsing the pressure of the gas.

The control system and/or the apparatus may be arranged and adapted to vary the pressure of the gas by varying the pressure of the gas such that the pressure is temporarily increased when the ions are accelerated within the ion trap.

The ion source may be selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The ion source may comprise a continuous or pulsed ion source.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The collision, fragmentation or reaction device may be selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass analyser may be selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The mass filter may be selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of the ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Various embodiments will now be described with reference to the figures.

Figure 1:
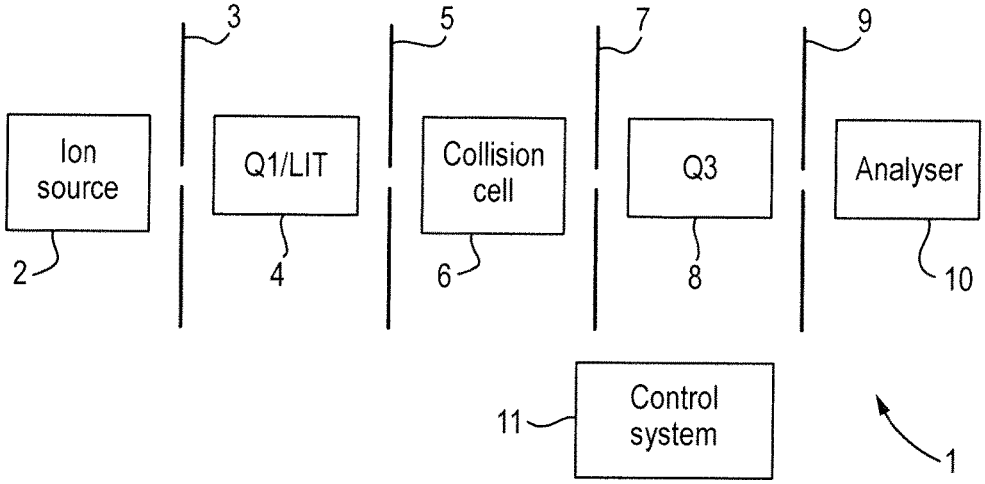
FIG. 1 shows a mass and/or ion mobility spectrometer in accordance with various embodiments.

FIG. 1 schematically shows a relevant portion of a mass and/or ion mobility spectrometer 1 that may be operated in accordance with various embodiments. It should be noted that FIG. 1 is only schematic, and that, for example, in practice the spectrometer 1 may comprises additional devices and stages.

The spectrometer 1 comprises an ion source 2, a first quadrupole mass filter ("Q1") 4 which may be arranged downstream of the ion source 2, a fragmentation, collision or reaction device or cell 6 which may be arranged downstream of the first quadrupole mass filter 4, a second quadrupole mass filter ("Q3") 8 which may be arranged downstream of the fragmentation, collision or reaction cell 6, and an analyser 10 which may be arranged downstream of the second quadrupole mass filter 8. The spectrometer 1 also comprises a control system 11 for controlling operation of the spectrometer 1, i.e. for causing the spectrometer 1 to operate in the manner described herein.

The ion source 2 may comprise an atmospheric pressure ion source operating at atmospheric pressure. The first quadrupole mass filter ("Q1") 4 may be arranged in a first vacuum chamber which may be separated from the atmospheric pressure region of the ion source 2 by an atmospheric pressure interface and/or differential pumping aperture 3. The fragmentation, collision or reaction device 6 may be arranged in a second different vacuum chamber which may be separated from the first vacuum chamber by a differential pumping aperture 5. The second quadrupole mass filter ("Q3") 8 may be arranged in a third different vacuum chamber which may be separated from the second vacuum chamber by a differential pumping aperture 7. The analyser 10 may be arranged in a fourth different vacuum chamber which may be separated from the third vacuum chamber by a differential pumping aperture 9.

The illustrated spectrometer 1 comprises a tandem mass spectrometer, i.e. a spectrometer comprising a first quadrupole mass filter ("Q1") 4, a fragmentation, collision or reaction device or cell 6 arranged downstream of the first quadrupole mass filter 4, and a second quadrupole mass filter ("Q3") 8 arranged downstream of the fragmentation, collision or reaction cell 6. However, other embodiments are contemplated wherein the spectrometer 1 may comprise different numbers of quadrupole mass filters, such as a single quadrupole mass filter, or two, three, or more quadrupole mass filters, e.g. arranged in series.

Figure 2:
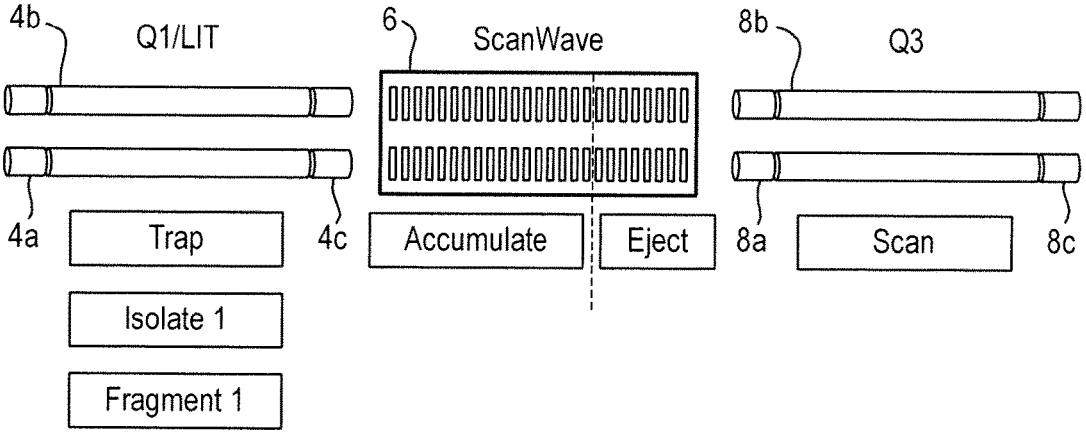
FIG. 2 shows an arrangement according to various embodiments.

FIG. 2 schematically shows the mass and/or ion mobility spectrometer 1 in more detail. Again, FIG. 2 is only schematic, and in practice the spectrometer 1 may comprises additional devices and stages.

As shown in FIG. 2, the first quadrupole mass filter 4 may comprise a first pre-filter quadrupole 4*a*, a first analytical quadrupole 4*b* which may be arranged downstream of the first pre-filter quadrupole 4*a*, and a first post-filter quadrupole 4*c* which may be arranged downstream of the first analytical quadrupole 4*b*.

The fragmentation, collision or reaction device 6 may comprise any suitable such device, including any one of the fragmentation, collision or reaction cells described herein. In particular, the fragmentation, collision or reaction device 6 may comprise a ScanWave® collision cell comprising a plurality of electrodes each having an aperture through which ions are transmitted and wherein one or more transient DC voltages are applied to the electrodes. The fragmentation, collision or reaction device 6 may be operated at a relatively high pressure (e.g. when compared with the first quadrupole mass filter 4 and the second quadrupole mass filter 8) such that ions are fragmented by Collision Induced Dissociation ("CID") within the fragmentation, collision or reaction device 6.

The second quadrupole mass filter 8 may comprise a second pre-filter quadrupole 8*a*, a second analytical quadrupole 8*b* which may be arranged downstream of the second pre-filter quadrupole 8*a* and a second post-filter quadrupole 8*c* which may be arranged downstream of the second analytical quadrupole 8*b*.

Each of the first pre-filter quadrupole 4*a*, the first analytical quadrupole 4*b*, the first post-filter quadrupole 4*c*, the second pre-filter quadrupole 8*a*, the second analytical quadrupole 8*b* and the second post-filter quadrupole 8*c* may respectively comprise a set of four rod electrodes which may be arranged substantially parallel to and spaced apart from one another, e.g. substantially parallel to and spaced apart from a central axis of the respective quadrupole mass filter 4,8, e.g. substantially parallel to the direction in which ions travel in use.

The first pre-filter quadrupole 4*a*, the first analytical quadrupole 4*b*, and the first post-filter quadrupole 4*c* may comprise respective segments of a first segmented rod set, and the second pre-filter quadrupole 8*a*, the second analytical quadrupole 8*b* and the second post-filter quadrupole 8*c* may comprise respective segments of a second segmented rod set.

As shown in FIG. 2, the first pre-filter quadrupole 4*a* and the first post-filter quadrupole 4*c* may each have an axial length (i.e. in the direction parallel to the rods or the direction in which ions travel in use) that is much less than the axial length of the first analytical quadrupole 4*b*. Similarly, the second pre-filter quadrupole 8*a* and the second post-filter quadrupole 8*c* may each have an axial length that is much less than the axial length of the second analytical quadrupole 8*b*. Accordingly, the mass to charge ratio resolution of the first pre-filter quadrupole 4*a* and the first post-filter quadrupole 4*c* may be much less than the mass to charge ratio resolution of the first analytical quadrupole 4*b*, and the mass to charge ratio resolution of the second pre-filter quadrupole 8*a* and the second post-filter quadrupole 8*c* may be much less than the mass to charge ratio resolution of the second analytical quadrupole 8*b*.

Ions may be arranged to be accumulated in the first quadrupole mass filter 4 which may be arranged to act as a linear ion trap ("LIT"), e.g. by applying a trapping DC voltage to entrance and/or exit electrodes. An entrance plate of the fragmentation, collision or reaction device 6 may be arranged to act as the exit electrode of the linear ion trap. A differential pumping aperture 3 or other electrode arranged upstream of the first quadrupole mass filter 4 may be arranged to act as an entrance electrode of the linear ion trap.

Ions may be confined axially (i.e. in the direction parallel to the rods or the direction in which ions travel in use) within the linear ion trap 4 due to the one or more applied DC voltages. The ions may also be confined radially (i.e. in the direction perpendicular to the rods or the direction in which ions travel in use) within the linear ion trap 4 by applying an RF voltage to the rods of the quadrupole mass filter 4 or linear ion trap.

Ion isolation of ions accumulated within the linear ion trap 4 (i.e. filtering of the ions according to their mass to charge ratio) may be achieved by pulsing ON an appropriate resolving DC voltage to the quadrupole mass filter 4 for a short period of time (e.g. a few hundred μs).

Fragmentation of the ions may then be performed by pulsing the pre-filter 4*a* and/or post-filter 4*c* to a lower voltage than that of the main (analytical) quadrupole rod set 4*b*. Ions trapped within the linear ion trap 4 may be accelerated into the pre-filter 4*a* and/or into the post-filter 4*c*. The ions may be accelerated into gas which may flow out of the ion source 2 upstream of the linear ion trap and which may also flows out of the collision cell 6. This may lead to Collision Induced Dissociation ("CIS") of the ions due to collisions with gas molecules, e.g. within the pre-filter 4*a* and/or the post filter 4*c*.

The ions may be prevented from leaving or exiting the linear ion trap 4 by the trapping voltages which may be applied to the differential aperture 3 and/or to a collision cell 6 entrance plate or electrode.

The resulting fragment or daughter ions may then be passed into the fragmentation, collision or reaction cell 6.

The fragment ions may be subjected to further CID fragmentation as they are accelerated into the collision cell 6 to form second generation fragment ions. The second generation fragment ions may then be subjected to $MS^2$ analysis, e.g. by accumulating the ions within an upstream region of the fragmentation, collision or reaction cell 6, before ejecting the ions (e.g. in a standard ScanWave® linked scan experiment), and scanning a mass to charge ratio window of the second quadrupole mass filter 8 to generate an $MS^2$ spectrum.

Figure 3A:
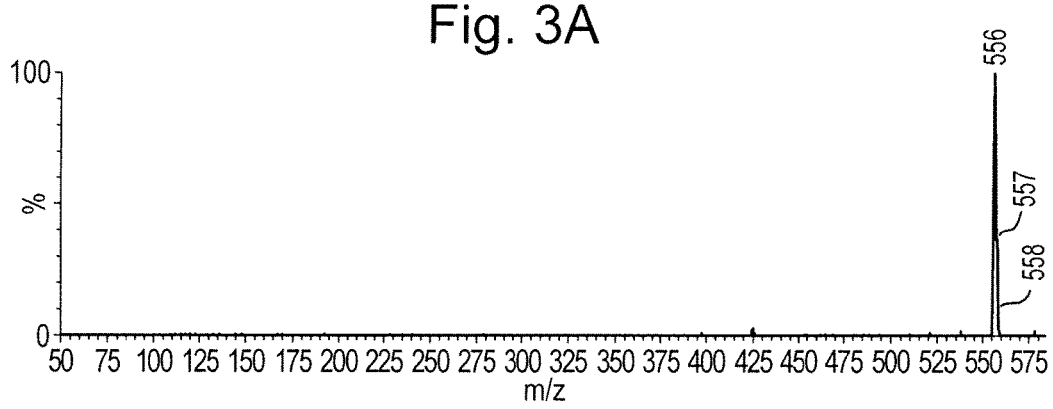
FIG. 3A shows a mass spectrum obtained with no pre-filter fragmentation.
Figure 3B:
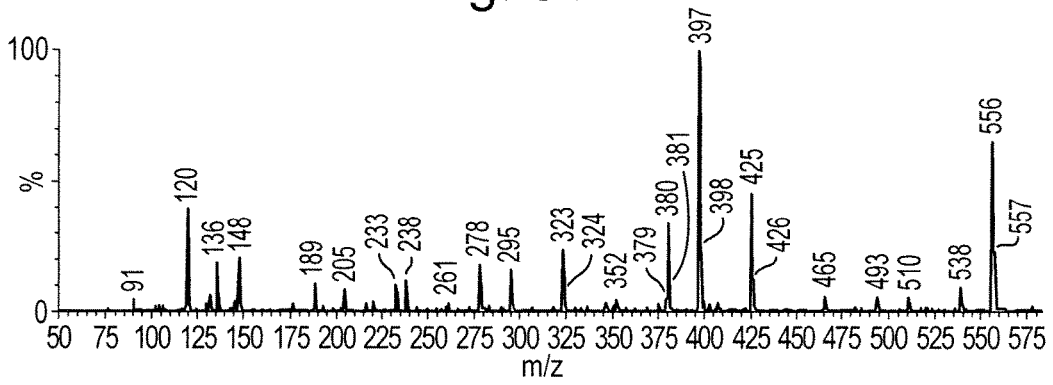
FIG. 3B shows a mass spectrum obtained with pre-filter fragmentation according to an embodiment and FIG. 3C shows a mass spectrum obtained by a conventional method of Collision Induced Dissociation fragmentation.
Figure 3C:
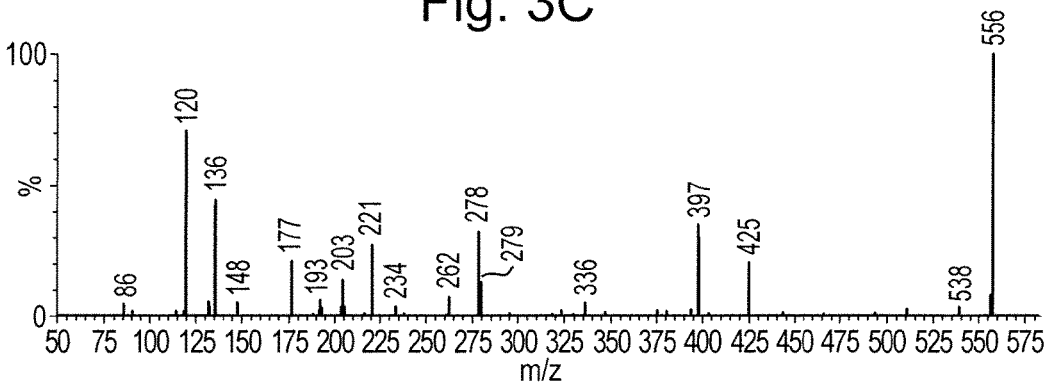

FIGS. 3A-3C shows illustrative experimental data that was obtained using Leu-Enk in order to demonstrate the operation of various embodiments.

FIG. 3A shows a parent ion mass spectrum which was obtained when no fragmentation pulse was applied to either the pre-filter 4*a* or the post filter 4*c*.

A daughter ion mass spectrum is shown in FIG. 3B which was obtained by applying a −15 V pulse to both the pre-filter 4*a* and to the post filter 4*c*.

The parent ion mass spectrum shown in FIG. 3A shows relatively intense un-fragmented Leu-Enk parent ions having mass to charge ratios of 556, 557 and 558. In contrast, the daughter ion mass spectrum shown in FIG. 3B shows depleted parent ion peaks and a rich series of fragment ions.

The fragment ions which were obtained in accordance with various embodiments as shown in FIG. 3B were compared with those observed using a conventional collision cell to fragment the ions by Collision Induced Dissociation ("CID"). The mass spectrum shown in FIG. 3C shows a mass spectrum which was obtained by fragmenting ions according to a conventional method in a conventional collision cell.

A comparison of the daughter ion mass spectrum obtained in accordance with various embodiments and as shown in FIG. 3B with a conventional daughter ion mass spectrum as shown in FIG. 3C reveals that there are many identical fragment ions in the mass spectrum shown in FIG. 3B but that also that there are several ions which are normally weak or completely absent but which are beneficially observed in the mass spectrum shown in FIG. 3B which was obtained in accordance with various embodiments.

It will be apparent, therefore, that various embodiments provide a particularly beneficial and improved method of fragmenting ions.

The new technique of fragmenting ions according to various embodiments has some similarities to the known technique of ion threshing in that ions are accelerated along the optic axis of the instrument. However, a significant difference of the approach according to various embodiments is that ions are accelerated from one stage of a quadrupole mass filter into another device stage of the quadrupole mass filter rather than being repeatedly accelerated and then decelerated within a single stage of a quadrupole mass filter according to the known conventional approach.

Various embodiments comprise a relatively simple method of fragmenting ions which beneficially does not require any modification to existing quadrupole mass filter/linear ion trap/tandem mass spectrometer hardware (since separate pre- and post-filters are typically provided in quadrupole systems) in contrast to conventional ion threshing approaches.

In various embodiments, the quadrupole mass filter 4 may be arranged downstream of a stage or device that may be operated at a higher pressure than that of the quadrupole mass filter 4 (such as an atmospheric pressure ion source 2 as described above or another device). The mass filter 4 may also be located upstream of a stage or device that may be operated at a higher pressure than that of the quadrupole mass filter 4 (such as a gas fragmentation, reaction or collision cell 6 as described above or another device).

According to various embodiments, one or both of the end regions (e.g. the pre-filter 4*a* and/or post-filter 4*c*) of the quadrupole mass filter 4 may receive gas flowing out from the upstream device or stage (e.g. the ion source 2) and/or out of the downstream device (e.g. collision cell 6) such that one or both of the end regions 4*a*,4*c* are maintained at a higher pressure than the central region (i.e. the analytical quadrupole 4*b*) of the quadrupole mass filter 4. This means that in accordance with various embodiments a pressure differential may exist within the quadrupole mass filter 4.

In accordance with various embodiments by accelerating ions into a relatively high pressure region of the quadrupole mass filter 4 (e.g. the pre-filter 4*a* and/or post-filter 4*c*), the efficiency of CID fragmentation may be beneficially improved when compared with a conventional ion threshing approach of accelerating and then decelerating ions within a single region or stage.

Various further embodiments are also contemplated.

Ions may be trapped and may be cooled in the pre-filter 4*a* and/or post filter 4*c* and then the potential experienced by the ions may be raised so that the ions are then accelerated into the analytical quadrupole rod set 4*b*, i.e. instead of the other way around.

Multiple fragmentation pulses may be performed, i.e. multiple fragmentation pulses may be applied to the pre-filter 4*a* and/or the post filter 4*c*.

An axial electric field may be used to push or force ions towards (or away from) the pre-filter 4*a* and/or the post filter 4*c* in order to speed up the fragmentation.

A pulsed gas source may be used in order to temporarily increase the pressure differential, i.e. temporarily to increase the pressure within the pre-filter 4*a* and/or the post-filter 4*c*. The pulsed gas source may be arranged to vary (i.e. increase or decrease) the pressure within the pre-filter 4*a* and/or the post-filter 4*c* at the same time as and/or in synchronism with the fragmentation pulses being applied to the pre-filter 4*a* and/or post filter 4*c*. That is, the pressure of gas provided to the quadrupole 4 may be varied such that the pressure in the pre-filter 4*a* and/or the post-filter 4*c* is temporarily increased when ions are accelerated and fragmented within the quadrupole 4. This may result in improved fragmentation at the times when fragmentation is required without adversely affecting the operation of the quadrupole 4 at other times (e.g. without affecting a (subsequent) resolving/filtering mode of operation).

Rather than utilising a segmented device comprising a pre-filter 4*a* and a post filter 4*c*, one or more external vane electrodes or a similar arrangement may be used to change the potential energy at the end(s) of the quadrupole. This is particularly beneficial when a pressure differential is maintained within the quadrupole 4 as described above. In these embodiments, the second electrode set 4*b* (the analytical quadrupole) need not be arranged entirely downstream of the first electrode set (a plurality of first vane electrodes), and the third electrode set (a plurality of second vane electrodes) need not be arranged entirely downstream of the second electrode set.

Although the method of and apparatus for fragmenting ions has been described above in terms of performing $MS^3$ in a tandem mass spectrometer, in various embodiments the method of may be used on its own, or as part of or in combination with any appropriate method of or apparatus for mass spectrometry, such as MS, $MS^2$ or $MS^n$.

Although the present invention has been described with reference to preferred embodiments, it will be understood by those skilled in the art that various changes in form and detail may be made without departing from the scope of the invention as set forth in the accompanying claims.

The invention claimed is:

1. A method of fragmenting ions comprising:

providing a linear ion trap comprising: (i) a first electrode set comprising a plurality of first electrodes; (ii) a second electrode set arranged downstream of said first electrode set and comprising a plurality of second electrodes; and (iii) a third electrode set arranged downstream of said second electrode set and comprising a plurality of third electrodes;

axially confining ions within said linear ion trap; and varying either: (i) a potential difference between at least some of said first electrodes and at least some of said second electrodes; and/or (ii) a potential difference between at least some of said second electrodes and at least some of said third electrodes, in order to axially accelerate at least some ions confined within said linear ion trap from said second electrode set into said first electrode set and/or said third electrode set in order to cause said ions to fragment so as to form fragment or daughter ions.

2. A method as claimed in claim 1, wherein:

said plurality of first electrodes comprises a plurality of rod electrodes;

said plurality of second electrodes comprises a plurality of rod electrodes; and said plurality of third electrodes comprises a plurality of rod electrodes.

3. A method as claimed in claim 1, wherein:

said first electrode set has an axial length less than an axial length of said second electrode set; and/or said third electrode set has an axial length less than the axial length of said second electrode set.

4. A method as claimed in claim 1, wherein:

said first electrode set comprises a pre-filter quadrupole;

said second electrode set comprises an analytical quadrupole; and said third electrode set comprises a post-filter quadrupole.

5. A method as claimed in claim 1, comprising:

providing gas to said ion trap; and varying with time the pressure of said gas provided to said ion trap in synchronism with axially accelerating said ions within said ion trap.

6. A method as claimed in claim 1, wherein said first electrode set, said second electrode set and said third electrode set form a segmented rod set.

7. A method as claimed in claim 1, further comprising:

generating one or more additional axial electric fields within said linear ion trap so as to urge at least some of said ions within said linear ion trap from said first electrode set and/or said third electrode set towards said second electrode set; and/or generating one or more additional axial electric fields within said linear ion trap so as to urge at least some of said ions within said linear ion trap from said second electrode set towards said first electrode set and/or said third electrode set.

8. A method as claimed in claim 1, wherein said first electrode set, said second electrode set and said third electrode set are arranged in a first vacuum chamber, and said method further comprises vacuum pumping said first vacuum chamber.

9. A method as claimed in claim 1, further comprising providing gas to said linear ion trap and/or to said first vacuum chamber such that the pressure within or at said second electrode set is less than the pressure within or at said first and/or third electrode set.

10. A method as claimed in claim 1, further comprising providing a first device or stage upstream of said first electrode set, said second electrode set and said third electrode set, wherein said first device or stage is coupled to said linear ion trap and/or to said first vacuum chamber via a differential pumping aperture and/or an atmospheric pressure interface.

11. A method as claimed in claim 10, further comprising providing gas to said linear ion trap and/or to said first vacuum stage from said first device or stage such that the pressure within or at said second electrode set is less than the pressure within or at said first electrode set.

12. A method as claimed in claim 11, wherein the pressure within or at said linear ion trap and/or said first vacuum chamber is less than the pressure within or at said first device or stage.

13. A method as claimed in claim 10, wherein said first device or stage comprises an ion source.

14. A method as claimed in claim 1, further comprising providing a second device or stage downstream of said first electrode set, said second electrode set and said third electrode set, wherein said second device or stage is coupled to said linear ion trap and/or to said first vacuum chamber via a differential pumping aperture.

15. A method as claimed in claim 14, further comprising providing gas to said linear ion trap and/or to said first vacuum chamber from said second device or stage such that the pressure within or at said second electrode set is less than the pressure within or at said third electrode set.

16. A method as claimed in claim 14, wherein said second device or stage comprises a collision, reaction or fragmentation device.

17. A method as claimed in claim 14, wherein the pressure within or at said linear ion trap and/or said first vacuum chamber is less than the pressure within or at said second device or stage.

18. A method as claimed in claim 1, further comprising varying the pressure of gas provided to said linear ion trap and/or to said first vacuum chamber at the same time as or in synchronism with said step of varying either: (i) said potential difference between at least some of said first electrodes and at least some of said second electrodes; and/or (ii) said potential difference between at least some of said second electrodes and at least some of said third electrodes.

19. A method as claimed in claim 18, wherein said step of varying said pressure of said gas comprises varying the pressure of said gas such that said pressure is temporarily increased.

20. A method as claimed in claim 1, wherein the pressure within or at said second electrode set is less than the pressure within or at said first and/or third electrode set.

21. Apparatus for fragmenting ions comprising:

a linear ion trap comprising: (i) a first electrode set comprising a plurality of first electrodes; (ii) a second electrode set arranged downstream of said first electrode set and comprising a plurality of second electrodes; and (iii) a third electrode set arranged downstream of said second electrode set and comprising a plurality of third electrodes; and a control system arranged and adapted:

(i) to cause ions to be axially confined within said linear ion trap; and (ii) to vary either: (a) a potential difference between at least some of said first electrodes and at least some of said second electrodes; and/or (b) a potential difference between at least some of said second electrodes and at least some of said third electrodes, in order to axially accelerate at least some ions confined within said linear ion trap from said second electrode set into said first electrode set and/or said third electrode set in order to cause said ions to fragment so as to form fragment or daughter ions.

22. Apparatus as claimed in claim 21, comprising:

a device arranged and adapted to provide gas to said ion trap;

control system is arranged and adapted:

to vary with time the pressure of said gas provided to said ion trap by said first device in synchronism with axially accelerating said ions within said ion trap.

* * * * *